US006539905B1

(12) United States Patent
Estacio et al.

(10) Patent No.: US 6,539,905 B1
(45) Date of Patent: Apr. 1, 2003

(54) GLOW PLUG CONNECTION APPARATUS

(75) Inventors: Edgardo Y. Estacio, Itasca, IL (US); Franco Franchi, Wood Dale, IL (US); Andrew D. Merrick, Lombard, IL (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 10/001,328

(22) Filed: Oct. 25, 2001

(51) Int. Cl.[7] ..... H05B 3/06

(52) U.S. Cl. ..... 123/145 A; 219/270; 219/523; 361/264; 123/142.5 E

(58) Field of Search ..... 123/145 A, 142.5 E; 219/267, 270, 523, 544; 361/264

(56) References Cited

U.S. PATENT DOCUMENTS

| | | | | | |
|---|---|---|---|---|---|
| 4,260,985 | A | * | 4/1981 | Hayden | 340/635 |
| 4,444,160 | A | * | 4/1984 | Steele | 123/179.21 |
| 4,632,076 | A | * | 12/1986 | Morgan et al. | 123/145 A |
| 4,963,717 | A | | 10/1990 | Woelfle | |
| 5,519,187 | A | | 5/1996 | Hinkle | |
| 5,589,091 | A | | 12/1996 | Muller | |
| 5,862,786 | A | | 1/1999 | Fuchs et al. | |
| 6,054,680 | A | | 4/2000 | Locher et al. | |
| 6,148,258 | A | * | 11/2000 | Boisvert et al. | 701/99 |
| 6,185,804 | B1 | | 2/2001 | Burns et al. | |
| 6,186,107 | B1 | | 2/2001 | Navalon Carretero | |
| 2002/0162834 | A1 | * | 11/2002 | Asano et al. | 123/145 A |

* cited by examiner

*Primary Examiner*—Erick Solis
(74) *Attorney, Agent, or Firm*—Dennis Kelly Sullivan; Jeffrey P. Calfa; Neil T. Powell

(57) ABSTRACT

There is provided a glow plug connection apparatus for installing a plurality of glow plug connectors to corresponding glow plugs mounted in a cylinder head in an internal combustion engine while simultaneously preventing engine oil leakage. The apparatus comprises a rigid buss bar rail, a plurality of glow plug connectors attached to the buss bar rail, a plurality of connector wires routed in the buss bar rail and connected to the glow plug connectors, a wire router, a conduit retaining clip, and an apparatus connector angle. Additionally, the glow plug connectors preferably comprises a buss bar rail interface section, a glow plug connector angle, a sealing section having an O-ring seal, a guide section having guide fins around the periphery of the glow plug connector, and a clip section having a clip fingers around the periphery of the glow plug connector able to engage a glow plug terminal.

35 Claims, 7 Drawing Sheets

Fig. 2
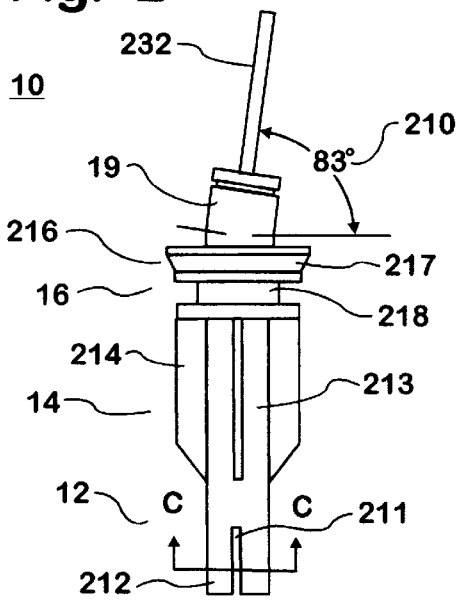
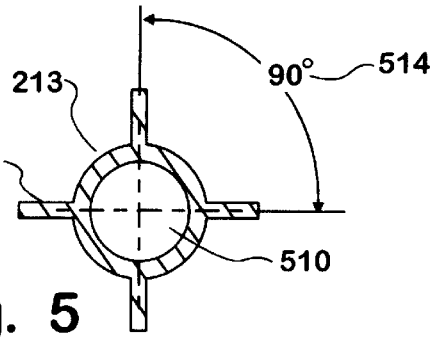
Fig. 5
SECTION B-B
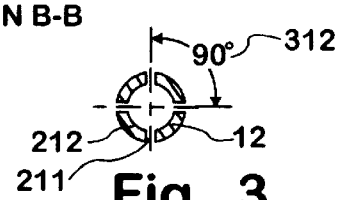
Fig. 3
SECTION C-C
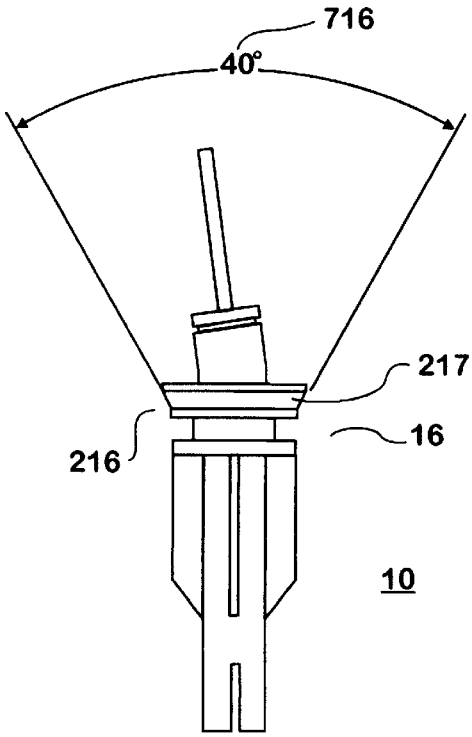
Fig. 7
Fig. 4
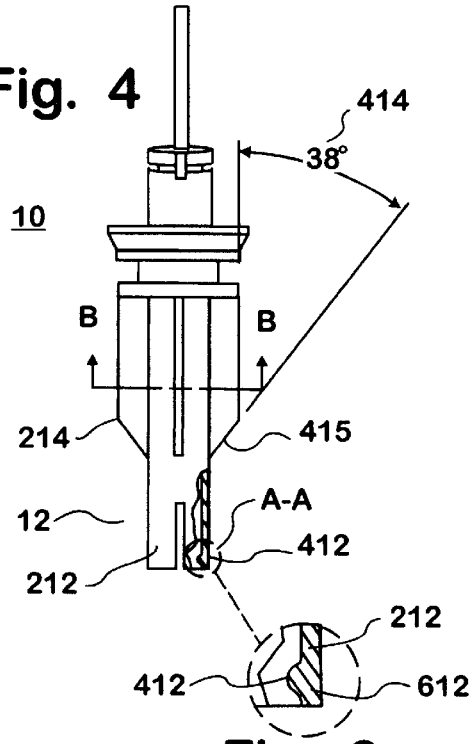
Fig. 6
VIEW A-A

GLOW PLUG CONNECTION APPARATUS

FIELD OF THE INVENTION

This invention relates generally to glow plugs in engine cylinder heads in internal combustion engines. More particularly, this invention relates to a glow plug connection device for use in an internal combustion engine having a rocker carrier.

BACKGROUND OF THE INVENTION

Internal combustion engines commonly employ cold start devices, such as a glow plug, to assist in ignition. Existing engine designs commonly have glow plugs located inside the engine valve cover. A glow plug, shown in FIG. 9, is generally used to preheat the combustion chamber mixture of a diesel engine, or an auto-ignition internal combustion engine, to assist in cold starting. The single glow plug corresponding to a combustion chamber is generally secured to or installed in the cylinder head of the engine such that there is an equal number of combustion chambers and glow plugs. For example in a diesel engine with a V-8 configuration, there will be a total of eight glow plugs with four glow plugs on each cylinder bank.

Each glow plug is typically electronically connected to a power source via a single glow plug connector attached to an under-valve cover wire harness. The under-cover valve cover wire harness is then appropriately electronically connected to an external engine harness which is in turn connected to an engine power source. The interface between under-valve cover and external harnesses provides a sealing function that prevents engine oil leakage. In the interior of the valve cover, the glow plug connectors, attached to the under-valve cover wire harness, are individually connected to corresponding glow plugs. This often times leads to crowding of engine components in the limited space under the valve cover. Also, the installation of each glow plug connector individually to each glow plug terminal results in increased manufacturing time and costs.

Further, mounting existing wire harness glow plug connectors individually to the glow plugs can be difficult, time consuming and requires some force to push and connect the wire harness connectors to the glow plug terminals. The wire harness connectors can be connected manually or with special insertion tools. Due to the limited space under the valve cover, it is difficult to individually install glow plug connectors properly to corresponding glow plug terminals. Many times, the resultant electrical connection between the glow plug connector and the glow plug terminal is many times not secure and electrically inadequate. As a result electrical testing is normally required to verify that there is adequate electrical contact between the glow plug connector and the glow plug terminal. The required testing is a drawback that also leads to increased engine manufacturing time and cost.

Accordingly, there is a need for a glow plug connection apparatus that is easy to install, prevents engine oil leaks and results in a consistently good electrical connection between the glow plug connector and glow plug thereby reducing engine manufacturing time and costs.

SUMMARY OF THE INVENTION

The present invention provides a glow plug connection apparatus for electrically connecting to a plurality of glow plugs while simultaneously sealing the engine from oil leakage. The glow plug connection apparatus simultaneously installs a plurality of glow plug connectors to corresponding glow plugs mounted in a cylinder head in an internal combustion engine. The glow plug connection apparatus comprises, a rigid buss bar rail, a plurality of glow plug connectors attached to the rigid buss bar rail, a plurality of connector wires routed in the rigid buss bar rail and electrically connected to corresponding glow plug connectors, a wire router, and a conduit retaining clip between the wire router and the rigid buss bar rail. The rigid buss bar rail and the glow plug connectors preferably form an apparatus connector angle. The glow plug connector wires can terminate in a multi-port glow plug wire connector or a single connection point.

Additionally, the glow plug connector of the glow plug connection apparatus preferably comprises a buss bar rail interface section, a sealing section having an O-ring seal able to seal the glow plug connector to a glow plug passage, a guide section having a plurality of guide fins around the periphery of the glow plug connector, and a clip section having a plurality of clip fingers around the periphery of the glow plug connector able to engage a glow plug terminal. In a preferred embodiment, at least one the clip fingers has a protruding lip. The buss bar rail interface section and the glow plug connector body preferably form a glow plug connector angle.

The following drawings and description set forth additional advantages and benefits of the invention. More advantages and benefits are obvious from the description and may be learned by practice of the invention.

BRIEF DESCRIPTION OF THE DRAWINGS

The present invention may be better understood when read in connection with the accompanying drawings, of which:

FIG. 2 shows a front view of a glow plug connector of the glow plug connection apparatus shown in FIG. 1;

FIG. 3 shows a cross-sectional view along a section line C—C of a clip section of the connector shown in FIG. 2;

FIG. 4 shows a side view of the glow plug connector shown in FIG. 2;

FIG. 5 shows a cross-sectional view along a section line B—B of a guide section of the glow plug connector shown in FIG. 4;

FIG. 6 shows an enlarged detail view A—A of a clip finger of the glow plug connector shown in FIG. 4;

FIG. 7 shows a rear view of the glow plug connector shown in FIG. 2;

DESCRIPTION OF THE INVENTION

Figure 1:
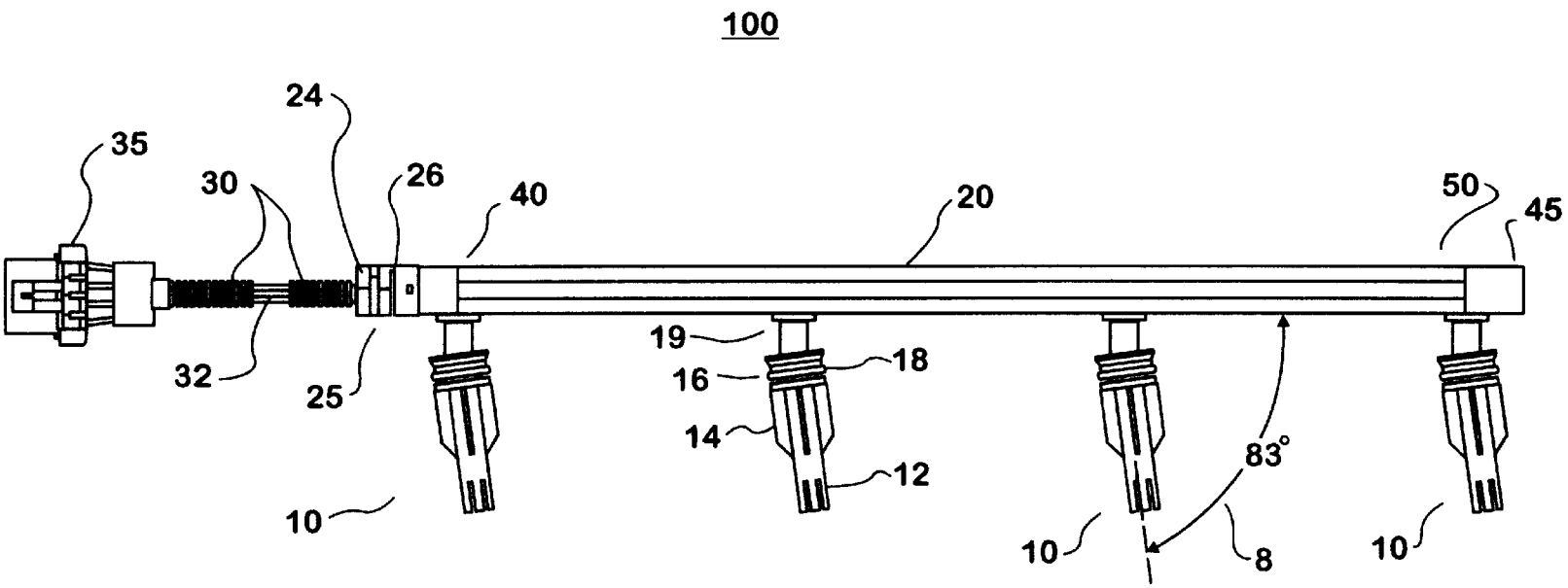
FIG. 1 shows a front view of an embodiment of a glow plug connection apparatus according to the present invention.

FIG. 1 shows a front view of an embodiment of a glow plug connection apparatus 100 the present invention. The glow plug connection apparatus 100 comprises a rigid routing or buss bar rail 20, a plurality of glow plug connectors 10, a conduit retaining clip 25, a wire conduit 30, glow plug connector wires 32, and a glow plug wire connector 35. The glow plug connection apparatus 100 is preferably adapted for mounting in a rocker carrier 820 (shown in FIG. 8) which is mounted on a cylinder head (not shown) in an internal combustion engine. The rocker carrier is the subject of a pending U.S. utility patent application by Zielke having Ser. No. 09/768,520. Both the present invention and the rocker carrier are assigned to a common entity, International Truck & Engine Corporation. The rocker carrier generally relates to a device for mounting and securing certain engine related components to a cylinder head, and is incorporated herein by reference.

Figure 8:
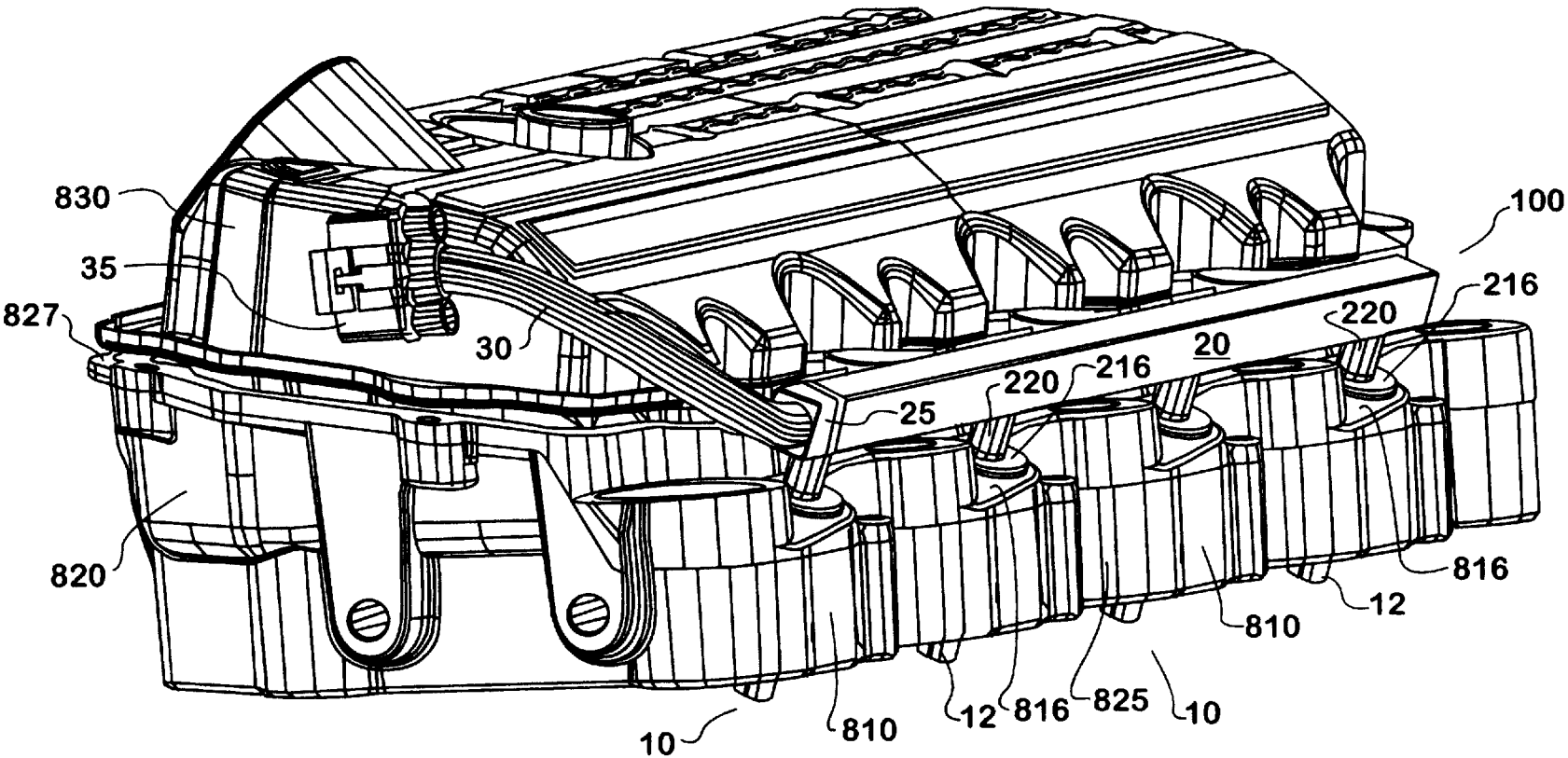
FIG. 8 shows an embodiment of the glow plug connection apparatus mounted on a rocker carrier.

FIG. 1 shows a four position glow plug connection apparatus 100, with four glow plug connectors 10, that would be connected to four corresponding glow plugs (shown in FIGS. 10 & 11) previously mounted on a cylinder head. The glow plug connection apparatus 100 depicted in FIGS. 1 and 8 is preferably mounted on the rocker carrier 820 which is mounted on one cylinder head bank side of a V-8 type engine. Those of skill in the art will readily recognize that the glow plug connection apparatus 100 cold also be easily modified to cooperatively mount on a rocker carrier for use on a on a six cylinder V-type engine. The glow plug connection apparatus 100 can be modified to comprise more or less glow plug connectors 10 depending on a particular engine application, e.g., three glow plug connectors 10 for one bank of a V-6 type engine. Additionally, the glow plug connection apparatus 100 shown in FIG. 1 can be mounted on a rocker carrier 820 that is mountable on either cylinder head bank or side of a V-type engine.

The buss bar rail 20 is preferably a rigid routing section for internally routing glow plug connector wires 32 between the glow plug connectors 10 and the glow plug wire connector 35. The buss bar rail is preferably configured of a hollow lengthwise rigid metal or steel section with a rectangular cross-section. The bus bar rail 20 can have other configurations, for example a square, circular or oval cross-section. Further, the hollow rigid steel or metal makeup of the buss bar rail 20 allows the glow plugs wires 32 protects the glow plug wires 32 from heat exposure in the engine compartment due to the engine or other engine components. Also, the glow plug connection apparatus 100 via the rigid buss bar rail 20 allows the glow plug connectors 10 to be simultaneously connected by pushing or pressing down on the rigid buss bar rail 20 until the glow plug connectors 10 engage the corresponding glow plugs 900 (shown in FIG. 9).

FIG. 1 shows that the buss bar rail 20 preferably comprises four glow plug connectors 10 attached substantially equidistant and parallel to each other and extending away from the buss bar rail 20 in the same direction. The glow plug connectors 10 are preferably comprised of a buss bar rail interface section 19, a sealing section 16 with an O-ring seal 18, a guide section 14 and a clip or snap-fit section 12. The glow plug connectors 10 are appropriately spaced along the buss bar rail 20 to correspond to glow plugs 900 installed in an engine cylinder head. Further, due to the physical inclined positioning of the glow plugs 900 in the engine cylinder head, the glow plug connectors 10 preferably form an apparatus connector angle 8 with respect to the rigid buss bar rail 20. In the embodiment shown in FIG. 1, the preferred apparatus connector angle 8 is about eighty-three degrees. Those of skill in the art will readily recognize that the apparatus connector angle 8 may vary to compliment the physical inclination of the glow plugs 900 in a particular engine application. The apparatus connector angle 8 also allows the buss bar rail 20 to maintain a substantially parallel relationship to the engine cylinder head or rocker carrier once installed (shown in FIG. 8).

FIG. 1 also shows a buss bar retaining clip 25 that is preferably positioned at the interface between the rigid buss bar rail 20 and the wire router or conduit 30. The wire conduit 30 is in turn attached to the glow plug wire connector 35. The glow plug wire connector 35 is preferably a four pin connector since there are four glow plug connectors 10 which correspond to four glow plug connector wires 32. The glow plug wire connector 35 will be plugged into an external engine harness or to a glow plug control module (not shown) where power can then be appropriately delivered. The glow plug wire connector 35, wire router 30 and bus buss retaining clip 25 combination is shown attached to a left side 40 of the buss bar rail 20. Those of skill in the art will readily recognize that this combination could also be positioned on an opposite right side 50 of the buss bar rail 20 if needed by a particular engine application.

The wire router 30 is preferably a flexible dress cover for ease in moving, positioning and routing the wire router 30 in the engine compartment area. The range of movement of the wire router 30 is enhanced by the buss bar retaining clip 25 which comprises a hinge clip section 24 that moves or pivots about a middle clip point 26. The glow plug wire connector 35 can thus be more easily routed as needed and plugged into an external engine harness or glow plug control module (not shown). Both the wire router 30 and the buss bar retaining clip 25 are preferably made up of flexible plastic based materials but other materials that allow convenient routing and movement of the glow plug wire connector 35 may be substituted.

FIG. 2 shows a front view of the glow plug connector 10 of the glow plug connection apparatus 10 shown in FIG. 1. The glow plug connector 10 is preferably comprised of a buss bar rail interface section 19, a sealing section 16 for use in conjunction with an O-ring seal 18 (shown in FIG. 1), a guide section 14 and a clip or snap-fit section 12 that will engages a top portion of the glow plug 913 (shown in FIG. 9). The buss bar rail interface section 19 is attached to the buss bar rail 20 as shown in FIG. 1. The buss bar interface section 19 is preferably inclined with respect to the glow plug connector body 10 by a glow plug connector angle 210. The preferred glow plug connector angle 210 is about eighty-three degrees. However, those of skill in the art will readily recognize that the glow plug connector angle 210 may vary depending on the physical inclination of the glow plugs 900 installed in a particular engine application. The glow plug connector angle 210 allows the glow plug connector 10 and the buss bar rail 20 to be attached in such a manner that the buss bar rail 20 can maintain a substantially parallel relationship to the engine cylinder head once the glow plug connection apparatus 100 is installed. This aspect results in the apparatus connector angle 8 discussed and shown in FIG. 1. Additionally, there is shown a portion of a glow plug connector wire 232 extending from the buss bar rail interface section 19 which connects the glow plug connector 10 to the glow plug wire connector 35.

FIG. 2 also shows in more detail the sealing section 16 which comprises an O-ring holder area 218 and a seating section 216. The O-ring holder area 218 is configured to hold an O-ring seal 18 (shown in FIG. 1) which will seal a glow plug passage 810 (shown in FIG. 8) in the rocker carrier. The O-ring seal 18 is preferably comprised of a rubber based material, e.g., it can be a Teflon coated Viton O-ring. Other materials that accomplish the sealing function may instead be used. The seating section 216 is preferably configured to have an external tapered seating face 217. The tapered seating face 21 will engage a complimentarily configured top glow plug passage section 816 (shown in FIG. 8) of the rocker carrier 820 when the glow plug connection apparatus 100 is installed. The O-ring seal 18 and the tapered seating face 217 allow the glow plug connectors 10 to be appropriately sealed in the rocker carrier 820 and to properly sit on the top glow plug passage 816 when the glow plug connection apparatus 100 is installed (shown in FIG. 8).

FIG. 2 also shows the guide section 14 which is preferably comprised of a plurality of guide fins 214 positioned in a substantially vertical manner around the periphery of a glow plug connector midsection 213. The guide fins 214 will appropriately align or position the glow plug connector 10 in glow plug passages 810 (shown in FIG. 8) to allow the glow plug connectors 10 to more easily travel in the glow plug passages 810 and thereby more easily and properly connect with the glow plugs 900 installed in the cylinder head (not shown). The guide fins 214 also give the glow plug connector 10 added structural strength and stability. The preferred embodiment shown in FIG. 2 comprises four guide fins 214 (shown in FIG. 5) spaced equidistantly at about 90 degrees from each other around the periphery of the connector midsection 213 for positioning of the glow plug connectors 10. Those of skill in the art will readily recognize that more or less fins could be used to accomplish the same function. Also, the degree distance 514 (shown in FIG. 5) between the guide fins 214 may be different from guide fin 214 to guide fin 214 so long as the proper positioning of the glow plug connector 10 in the glow plug passage 810 is achieved.

Further, FIG. 2 shows the glow plug clip section 12 at the bottom of the glow plug connector 10. The glow plug clip section 12 is preferably comprised of a plurality of clip fingers 212 positioned around the bottom periphery of the glow plug connector 10. In the embodiment shown, the glow plug clip section 12 comprises four clip fingers 212 (shown in FIG. 3) spaced equidistantly from each other around the bottom periphery of the glow plug connector 10. This physical arrangement results in finger spacings 211 between the clip fingers 212 that are equidistantly spaced at 90 degrees from each other (shown in FIG. 3). The equidistant finger spacings 211 allow for more efficient or equal distribution of forces encountered by the clip fingers 212. The clip fingers 212 preferably have a resilient and spring-like property so that they can expand and contract as required when a glow plug 900 is inserted into or removed from the glow plug connector 10. During installation of the glow plug connection apparatus 100, the clip fingers 212 expand to accept a glow plug terminal 912 (shown in FIG. 12) and then contract to secure the electrical connection to the glow plug terminal 912. Those of skill in the art will readily recognize that more or less clip fingers 212 could be used so long as the desired electrical connection of the glow plug connector 10 to the glow plug 900 is achieved and secured. Though equidistant spacing is preferred, the resultant finger spacings 211 between clip fingers 212 could be different from clip finger 212 to clip finger depending on a particular application.

FIG. 3 shows a cross-sectional view of the clip section 12 along a section line C—C of the glow plug connector 10 shown in FIG. 2. FIG. 3 clearly illustrates that in a preferred embodiment, the glow plug connector 10 clip section 12 is comprised of four clip fingers 212 equidistantly positioned around the periphery of a glow plug connector 10 and separated by four resulting finger spacings 211. The finger spacing 211 are preferably equidistantly spaced at 90 degrees apart from each other. The equidistant clip finger 212 arrangement allows for more efficient or equal distribution of forces encountered by the clip fingers 212 when a glow plug 900 is inserted or removed upon installation or removal of the glow plug connection apparatus 100.

FIG. 4 shows a side view of the glow plug connector shown in FIG. 2. A preferred configuration of the guide fins 214 is illustrated where the guide fin bottom 415 has an inclined construction. In this embodiment, the guide fin bottom 415 forms a fin angle 414 with the glow plug connector 10 of about 38 degrees. The guide fin angle 414 will ease the initial insertion of the glow plug connectors 10 into the glow plug passages 810 of the rocker carrier 820 (shown in FIG. 8). Those of skill in the art will recognize that other guide fin angles 414 would also accomplish the same function. FIG. 4 also shows a cutaway view A—A of the glow plug clip section 12 that partially highlights a preferred interior protruding lip 412 configuration of the clip fingers 212. The protruding lip 412 is an important part of the clip fingers 212 since it 412 is in part responsible for holding and securing the electrical connection between the glow plug connectors 10 to the glow plug 900.

FIG. 5 shows a cross-sectional view of the guide section 14 along the section line B—B of the glow plug connector 10 shown in FIG. 4. FIG. 5 shows that in the preferred embodiment, the glow plug 10 is comprised of four guide fins 214 spaced equidistantly at 90 degrees from each other around the periphery of the connector midsection 213. As noted previously, the guide fins 214 properly align or position the glow plug connector 10 in the glow plug passages 810 of the rocker carrier 820. More or less guide fins 214 could be used and the degree distance 514 between the guide fins 214 may be different from guide fin 214 to guide fin 214 so long as the proper alignment or positioning of the glow plug connector 10 in the glow plug passage 810 is achieved. FIG. 5 also shows the glow plug connector interior 510 which will preferably house a female type connector 1010 (shown in FIGS. 10 & 11). The female type connector 1010 is internally electrically connected (not shown) to the glow plug connector wire 32 (shown in FIG. 1) and accepts the insertion of the glow plug terminal tip 914 (shown in FIGS. 9 and 11).

FIG. 6 shows an enlarged detail of view A—A of the clip section 12 of the glow plug connector 10 showing a preferred interior configuration of the clip finger 212. The interiorly protruding lip 412 is an important aspect of the clip fingers 212. In conjunction with the resilient and spring-like nature of the clip fingers 212, it is the protruding lip 412 that is responsible for ultimately holding and securing the electrical connection between the glow plug connectors 10 to the glow plug 900. The protruding lip 412 preferably extends along the interior periphery of the clip finger 212 near the finger bottom 612 and each clip finger 212 preferably has a protruding lip 412. This allows for a better and more secure connection between the glow plug connectors 10 to the glow plug 900. Those of skill in the art will readily recognize that the protruding lip 412 could also extend only partially along the interior of the clip finger 212 or could be present in less than all the clip fingers 212. The preferred configuration of the clip fingers 212 results in a "snap-on" or "click-on" feature that allows an operator or installer to know when the glow plug connectors 10 are properly installed on the glow plugs 900.

FIG. 7 shows a rear view of the glow plug connector shown in FIG. 2. More particularly, FIG. 7 shows that the seating section 216 has a tapered seating face angle 716. which is preferably about 40 degrees. The tapered seating face 217 will interact with a complimentarily configured top glow plug passage section 816 of the glow plug passage 810 (shown in FIG. 8). The tapered seating face 217 allows the glow plug connectors 10 to properly sit on or engage the top glow plug passage section 816 of the glow plug passage once the glow plug connection apparatus 100 is installed (shown in FIG. 8). The tapered seating face angle 716 may take on other values complimentary to the top glow plug passage section 816.

FIG. 8 shows an embodiment of the rigid glow plug connection apparatus 100 mounted on a rocker carrier 820 with a valve cover 830, where the four glow plug connectors 10 are preferably mounted in the respective glow plug passages 810 of the rocker carrier 820. There is shown a rocker carrier 820 adapted for use with a cylinder head (not shown) in an internal combustion engine, e.g., on either engine bank or side of a V-8 type diesel engine. There is also shown a valve cover 830 that secures to the top periphery 827 of the rocker carrier 820 to thereby enclose the cylinder head. One of the various features of the rocker carrier 820 is that rocker arm assemblies with associated rocker arms (not shown) and other related components can be mounted to the rocker carrier 820.

Among other configurations, the rocker carrier 820 comprises a plurality of glow plug passages 810 in or adjacent to a front rocker carrier wall 825. The glow plug passages 810 preferably have an inclined or angled configuration in the front wall 825 of the rocker carrier 820. In this manner, the glow plug passages 810 are complimentary to the angled or inclined glow plug connectors 10 of the glow plug connection apparatus 100. There is also shown the inclined nature of the top glow plug passage section 816 of the glow plug passage 810. The top glow plug passage section 816 is preferably configured or angled to compliment the angled or inclined tapered seating face 217 (shown in FIG. 2) of the glow plug connector 10 sealing section 16. In this manner, the connection to the glow plugs 900 (shown in FIGS. 9–11) can be appropriately sealed via the O-ring seal 18 (shown in FIG. 1) on the sealing section 16.

In order to install the glow plug connection apparatus (also shown in FIG. 2), an installer preferably positions the buss bar rail 20 such that all the glow plug connectors 10 are inserted into the appropriate glow plug passages 810 of the rocker carrier 820. Next, the installer pushes or presses downward on the rigid buss bar rail 20 which thereby applies simultaneous force on the glow plug connectors 10. The glow plug guide sections 14, via the guide fins 414, align the glow plug connectors 10, as force is applied, for proper electrical connection to the glow plug terminal 912. This allows the glow plug connectors 10 to be simultaneously connected when the glow plug connectors 10 engage corresponding glow plug terminals 914 on the glow plugs 900 (shown in FIG. 9).

As the glow plug connectors 10 are pushed into place, the each glow plug terminal 912 enters the connector clip section 12. As the glow plug connector 10 continues moving downward, the glow plug clip fingers 212 encounter the glow plug terminal head 913. At this point, the configuration of the glow plug terminal head 913 forces the clip fingers 212 to expand as they continue to travel downward. When the clip section 12 reaches the glow plug terminal neck 915 the clip fingers 212 will rapidly contract and compressively seat around the periphery of the glow plug terminal neck 915. This rapid contraction results in a "snap" or "click" that typically should be audible to the installer. The installer also should be able to "feel" when the clip fingers have snapped onto the glow plug 900. Thus, the installer will know that there is a good electrical connection when he hears or "feels" the glow plug connectors 10 "snap-on" or "click-on" to the glow plug terminals 912.

At this point, the glow plug terminal tip 914 is inserted and electrically connected to the female type connector 1010 in the glow plug connection interior (shown in FIGS. 10 & 11) which is in turn connected (not shown) to the glow plug connector wire 32 (shown in FIG. 1). Also, the glow plug connectors 10 are now appropriately sealed against the glow plug passages 810 via the O-ring seal 18 and tapered seating face 217 of the sealing section 16 acting on the top glow plug passage section 816. If the glow plug connectors 10 are not properly installed, the O-ring seal should be visible. This is a signal to the installer that the glow plug connection apparatus needs to be reinstalled. Further, the rigid buss bar rail 20 should now be substantially parallel to the engine cylinder head (not shown) upon which the rocker carrier 820 is or will be installed. The rigid buss bar rail 20 is preferably parallel to the engine cylinder head to, among other things, minimize the amount of space used in the engine compartment. The glow plug wire connector 35 can now be plugged into an external engine harness, glow plug control module or other appropriate engine component for delivery of power to the glow plugs.

Figure 9:
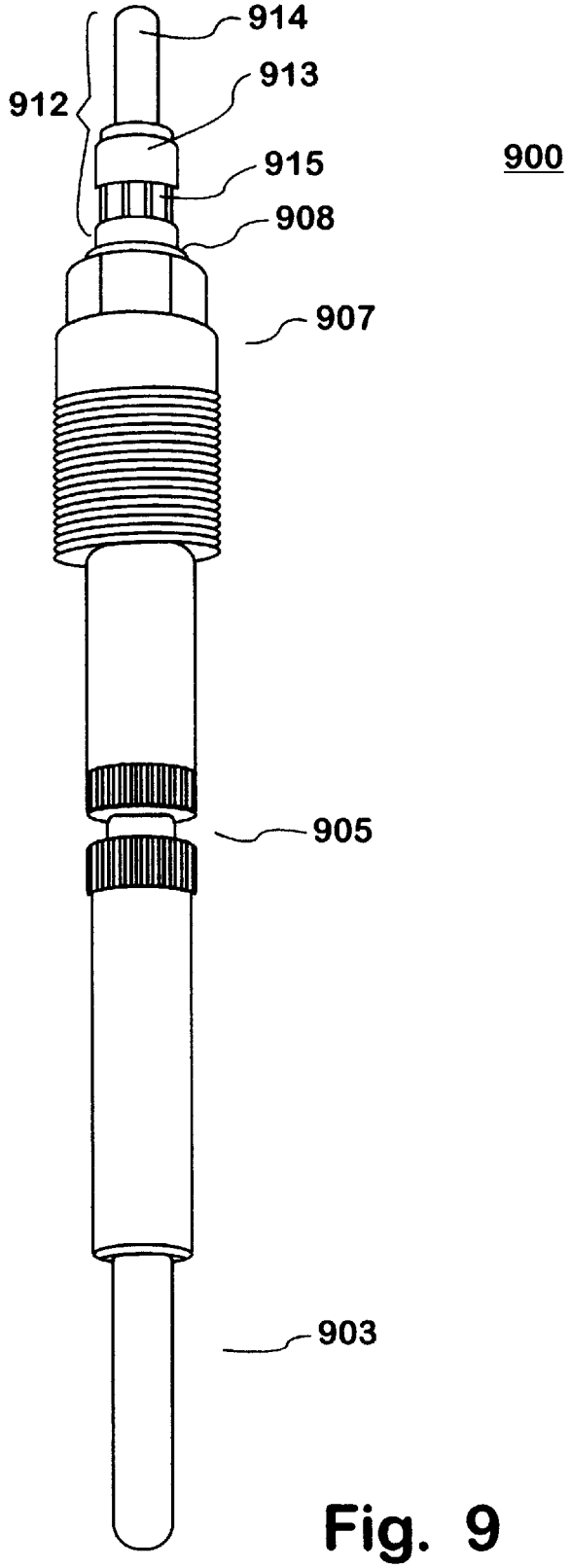
FIG. 9 shows a front view of a glow plug usable with the glow plug connectors shown in FIGS. 1–8.

FIG. 9 shows a typical glow plug 900 that could be used with the glow plug connectors shown in FIGS. 1–8. The glow plug 900 generally comprises a glow plug terminal 912, a cylindrical metal glow plug tube or body 905 and a heating element 903. The cylindrically tube 905 comprises the housing of the glow plug 900 that attaches to the cylinder head or engine block (not shown). The glow plug 900 is preferably threaded to the cylinder head or engine block via glow plug threads 907 on the exterior of the glow plug 900. The is also a glow plug terminal 912 at the top of the glow plug 900 that is insulated 908 from the glow plug body 905 and electrically connected to the heating element 903. The glow plug terminal 912 is comprised of a terminal tip 914, a terminal head 915 and a terminal neck 915. The heating element 903 is generally comprised of a ceramic heating element tip 903 that will heat up when power or electric current is applied to the glow plug terminal 912 to provide heat to the diesel mixture in the combustion chamber (not shown).

As discussed previously with respect to FIG. 8, the glow plug terminal tip 914 is inserted and electrically connected to the female type connector 1010 (shown in FIGS. 10 & 11) which is in turn connected (not shown) to the glow plug connector wire 32 (shown in FIG. 1). Also, the configuration of the glow plug terminal head 913 forces the resilient connector clip fingers 212 to expand as they travel around the terminal head 913. When the resilient connector clip section 12 reaches the glow plug terminal neck 915, the resilient connector clip fingers 212 rapidly contract and compressively seat around the periphery of the glow plug terminal neck 915. The installer will hear or "feel" when the connector clip fingers 212 snap or click onto the glow plug 900. The configuration of the glow plug terminal 914 and the make up of the glow plug connector 10 allows the installer to know when there is a good electrical connection when he/she hears or "feels" the glow plug connectors 10 "snap-on" or "click-on" to the glow plug terminal neck 915.

Figure 10:
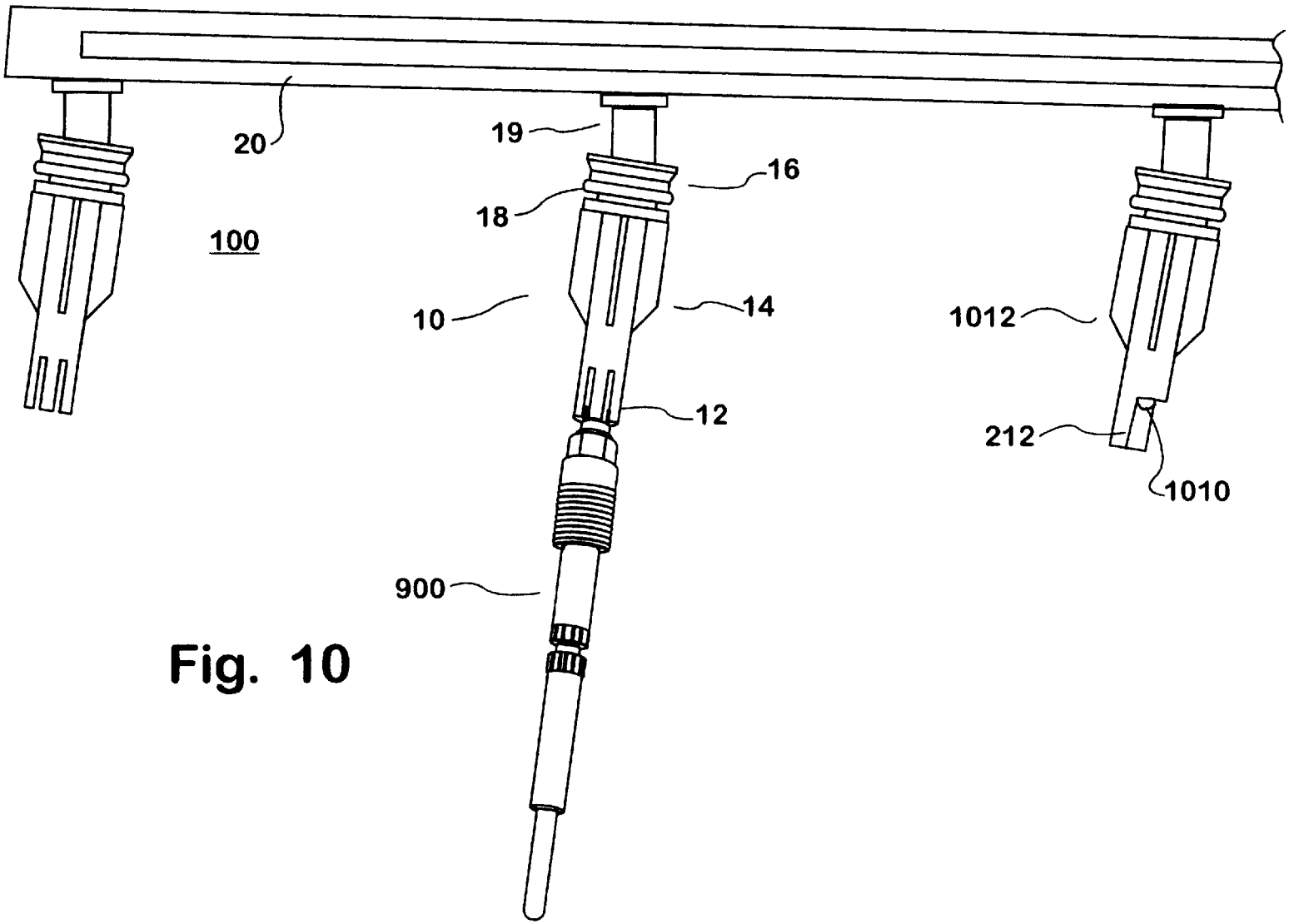
FIG. 10 shows a front view of an embodiment of the glow plug connection apparatus connected to a glow plug according to the present invention.

FIG. 10 shows a front view of an embodiment of the glow plug connection apparatus 100 with an installed glow plug 900. FIG. 10 shows three glow plug connectors 10 attached to the rigid buss bar rail 20 in a substantially equidistant and parallel manner and extending away from the buss bar rail 20. FIG. 10 also depicts a cutaway glow plug connector 1012 with a female type connector 1010 which is housed in the glow plug connector interior 510 (shown in FIG. 5). The female type connector 1010 is internally electrically connected (not shown) to the glow plug connector wire 32 (shown in FIG. 1) and accepts the insertion of the glow plug terminal 912 (shown in FIG. 11). There is also shown the clip fingers 212 of the snap fit section 12 that will additionally secure the glow plug connector 10 to the glow plug 900 at the glow plug terminal 912.

Figure 11:
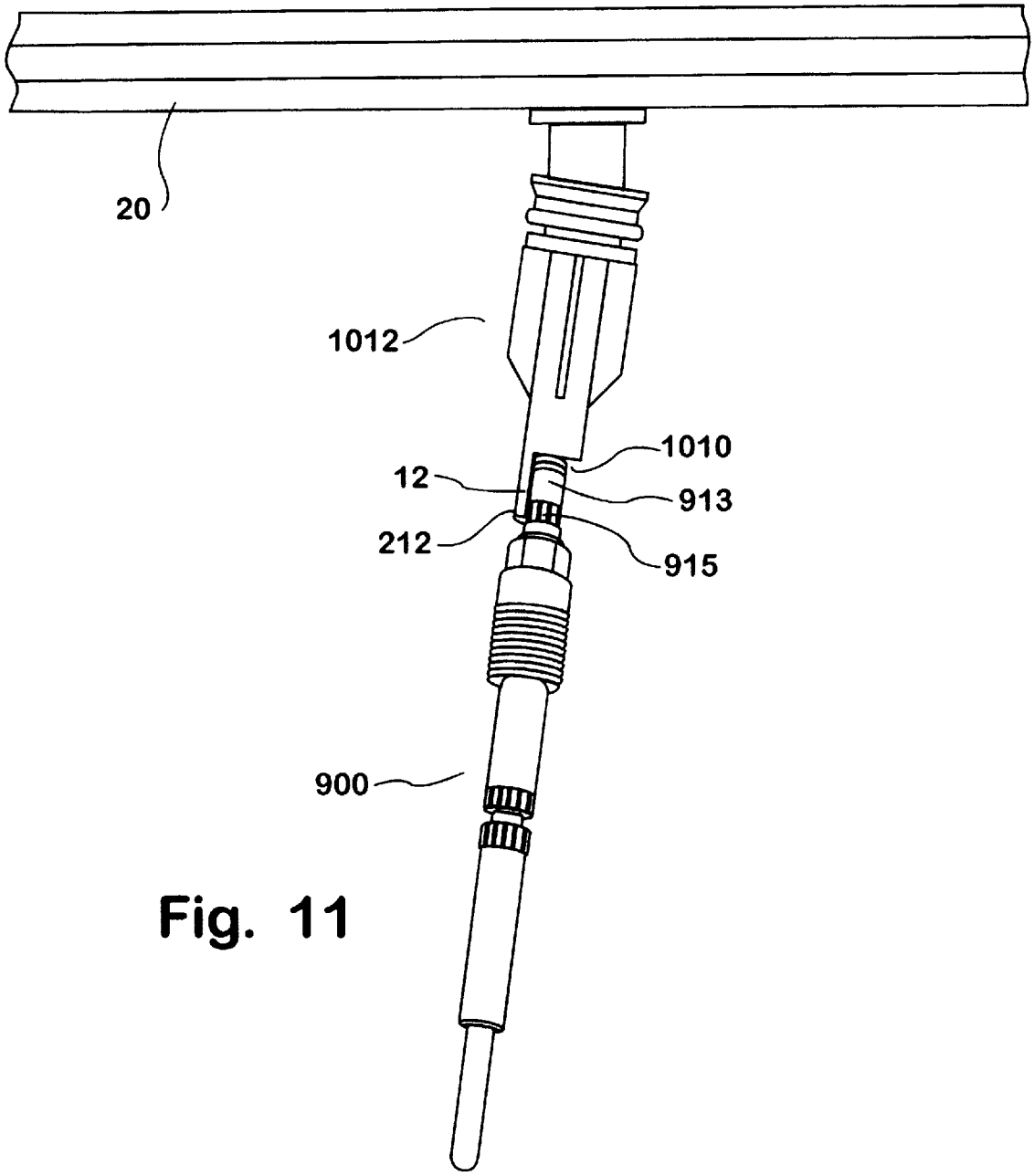
FIG. 11 shows a cut away view of the glow plug connector and glow plug terminal shown in FIG. 10.

FIG. 11 shows the cutaway glow plug connector 1012 of FIG. 10 with an installed glow 900. FIG. 11 shows that the terminal tip 914 of the glow plug terminal 912 is inserted in the female type connector 1010 of the glow plug connector 1012. FIG. 11 also shows that the clip fingers 212 extend past the glow plug terminal head 913 and down to the glow plug terminal neck 912 to secure and connect the glow plug connectors 10 and 1012 to the glow plug 900.

Figures 12, 13:
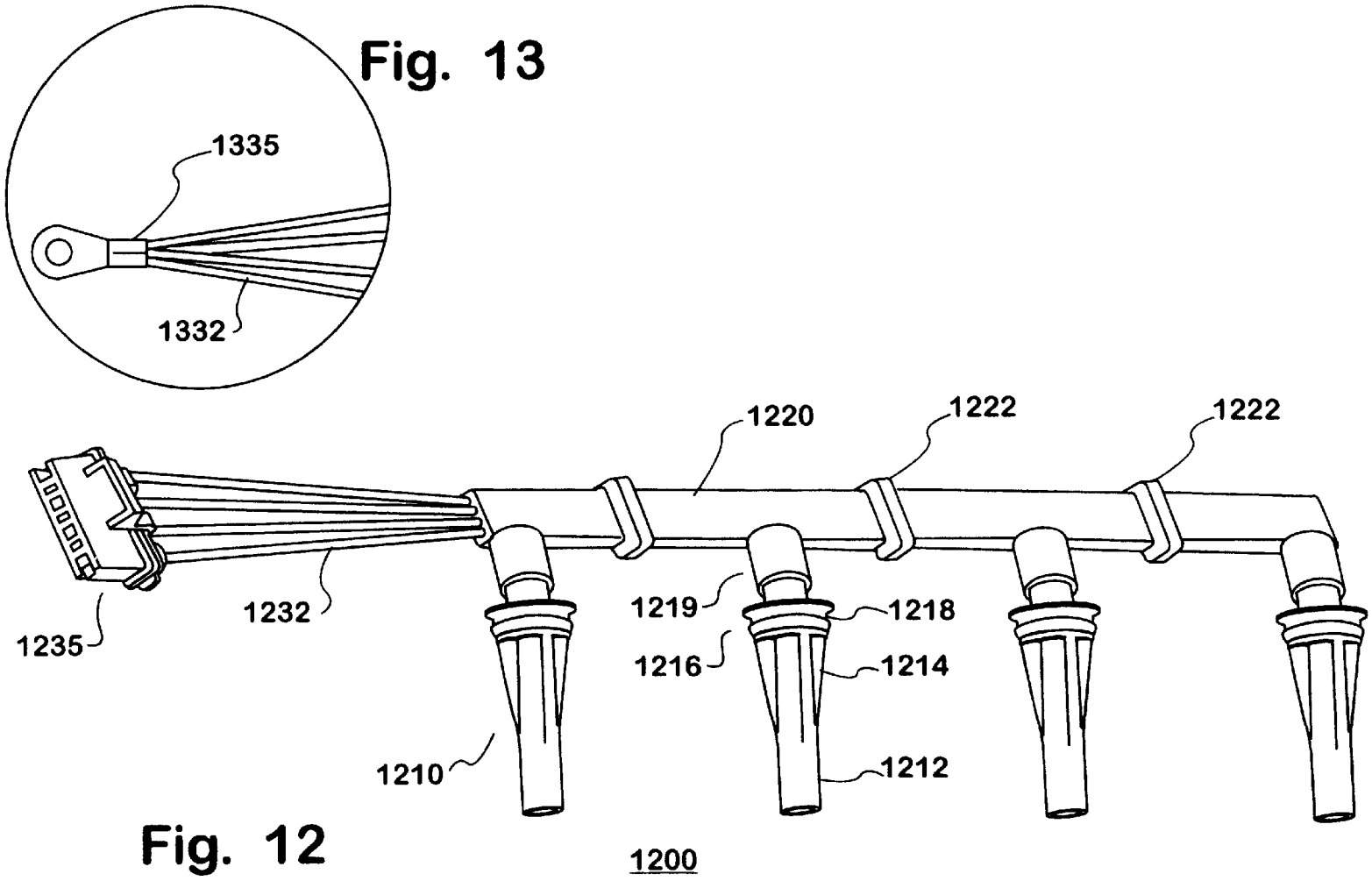
FIG. 12 shows a front view of an another embodiment of the glow plug connection apparatus according to the present invention.
FIG. 13 shows a partial view of an alternate embodiment of the glow plug connector wires shown in FIGS. 1 and 12.

FIG. 12 shows a perspective front view of an alternate embodiment of the glow plug connection apparatus 1200 adapted for mounting in a rocker carrier 820, similar to that shown in FIG. 8. The embodiment of the glow plug connection apparatus 1200 shown in FIG. 12 preferably comprises a rigid buss bar rail 1220, a plurality of glow plug connectors 1210, glow plug connector wires 1232, and a glow plug wire connector 1235. The rigid bus bar rail 1220, of this embodiment, additionally comprises strengthening and support sections 1222. The rigid buss bar 1220 has four glow plug connectors 1210 attached in a substantially equidistant and parallel manner and extending away from the buss bar rail 1220 in the same direction. The glow plug connectors 10 are preferably comprised of a buss bar rail interface section 1219, a sealing section 1216 with an O-ring seal 1218, a guide section 1214 and a clip or snap-fit section 1212 that engages the glow plug 900 (similar to that shown in FIG. 10). The glow plug connection apparatus 1210 is connected to the rocker carrier 820 (shown in FIG. 8) and the glow plugs (shown in FIG. 9) in a fashion as previously described in FIG. 8.

FIG. 13 shows a partial view of an alternate embodiment of the termination of the glow plug connector wires 1332. In this embodiment, the glow plug connector wires 1332 preferably terminate at a single connection point 1335 instead of a multi-port glow plug wire connector 35 and 1235 as depicted in FIGS. 1 and 12. In this embodiment, the glow plug connector wires 1332 have a single termination point thus power or electrical current is either provided to all or none of the glow plugs 900 (not shown) simultaneously. This is a configuration that could be useful in some engine applications.

The invention has been described and illustrated with respect to certain preferred embodiments by way of example only. Those skilled in that art will readily recognize that the preferred embodiments may be altered or amended without departing from the true spirit and scope of the invention. Therefore, the invention is not limited to the specific details, representative devices, and illustrated examples in this description. The present invention is limited only by the following claims and equivalents.

I claim:

1. A glow plug connection apparatus for installing at least one glow plug connector to a corresponding glow plug mounted in a cylinder head in an internal combustion engine, the glow plug connection apparatus comprising:

a rigid buss bar rail;

a plurality of glow plug connectors attached to the rigid buss bar rail; and a plurality of connector wires routed in the rigid buss bar rail and electrically connected to corresponding glow plug connectors.

2. The glow plug connection apparatus of claim 1, wherein the rigid buss bar rail and the glow plug connectors form an apparatus connector angle.

3. The glow plug connection apparatus of claim 1, further comprising a wire router.

4. The glow plug connection apparatus of claim 3, wherein the wire router is a flexible dress wire router.

5. The glow plug connection apparatus of claim 3, further comprising a conduit retaining clip between the wire router and the rigid buss bar rail.

6. The glow plug connection apparatus of claim 1, wherein the glow plug connector wires connect a glow plug connector to a glow plug wire connector.

7. The glow plug connection apparatus of claim 1, wherein the glow plug connector wires electrically connect the glow plug connector to a single connection point.

8. The glow plug connection apparatus of claim 5, comprising three or four glow plug connectors.

9. The glow plug connection apparatus of claim 1, wherein the glow plug connector comprises:

a buss bar rail interface section;

a sealing section having an O-ring seal able to seal the glow plug connector to a glow plug passage;

a guide section; and a clip section able to engage a glow plug terminal.

10. The glow plug connection apparatus of claim 9, wherein the guide section comprises a plurality of guide fins around the periphery of the glow plug connector.

11. The glow plug connection apparatus of claim 10, wherein the guide section comprises a four guide fins.

12. The glow plug connection apparatus of claim 9, wherein the clip section comprises a plurality of clip fingers around the periphery of the glow plug connector.

13. The glow plug connection apparatus of claim 12, wherein the guide section comprises a four clip fingers.

14. The glow plug connection apparatus of claim 12, wherein at least one clip finger comprises a protruding lip.

15. The glow plug connection apparatus of claim 9, wherein the buss bar rail interface section and the glow plug connector body form a glow plug connector angle.

16. The glow plug connection apparatus of claim 9, wherein the glow plug connector is integrally formed of plastic based material.

17. A glow plug connection apparatus for installing at least one glow plug connector to a corresponding glow plug mounted in a cylinder head in an internal combustion engine, the glow plug connection apparatus comprising:

a rigid buss bar rail;

a plurality of glow plug connectors attached to the rigid buss bar rail;

a plurality of connector wires routed in the rigid buss bar rail and electrically connected to corresponding glow plug connectors;

a wire router; and a conduit retaining clip between the wire router and the rigid buss bar rail;

wherein the rigid buss bar rail and the glow plug connectors form an apparatus connector angle.

18. The glow plug connection apparatus of claim 17, wherein the glow plug connector wires connect a glow plug connector to a glow plug wire connector.

19. The glow plug connection apparatus of claim 17, wherein the glow plug connector wires electrically connect the glow plug connector to a single connection point.

20. The glow plug connection apparatus of claim 17, wherein the glow plug connector comprises:

a buss bar rail interface section;

a sealing section having an O-ring seal able to seal the glow plug connector to a glow plug passage;

a guide section; and a clip section able to engage a glow plug terminal;

wherein the buss bar rail interface section and the glow plug connector body form a glow plug connector angles.

21. The glow plug connection apparatus of claim 20, wherein the guide section comprises a plurality of guide fins around the periphery of the glow plug connector.

22. The glow plug connection apparatus of claim 21, wherein the guide section comprises a four guide fins.

23. The glow plug connection apparatus of claim 22, wherein the clip section comprises a plurality of clip fingers around the periphery of the glow plug connector.

24. The glow plug connection apparatus of claim 23, wherein the guide section comprises a four clip fingers.

25. The glow plug connection apparatus of claim 23, wherein at least one clip finger comprises a protruding lip.

26. A glow plug connector comprising:

a buss bar rail interface section;

a sealing section having an O-ring seal able to seal the glow plug connector to a glow plug passage;

a guide section; and a clip section able to engage a glow plug terminal.

27. The glow plug connector of claim 26, wherein the guide section comprises a plurality of guide fins around the periphery of the glow plug connector.

28. The glow plug connector of claim 27, wherein the guide section comprises a four guide fins.

29. The glow plug connector of claim 26, wherein the clip section comprises a plurality of clip fingers around periphery of the glow plug connector.

30. The glow plug connector of claim 29, wherein the guide section comprises a four clip fingers.

31. The glow plug connector of claim 26, wherein at least one clip finger comprises a protruding lip.

32. The glow plug connector of claim 26, wherein the buss bar rail interface section and the glow plug connector body form a glow plug connector angle.

33. The glow plug connection apparatus of claim 9, wherein the glow plug connector is integrally formed of plastic based material.

34. A glow plug connector comprising:

a buss bar rail interface section;

a sealing section having an O-ring seal able to seal the glow plug connector to a glow plug passage;

a guide section having a plurality of guide fins around the periphery of the glow plug connector; and a clip section having a plurality of clip fingers around the periphery of the glow plug connector able to engage a glow plug terminal;

wherein the buss bar rail interface section and the glow plug connector body form a glow plug connector angle.

35. The glow plug connection apparatus of claim 34, wherein at least one clip finger comprises a protruding lip.

* * * * *